US009625868B2

(12) United States Patent
Kuroki

(10) Patent No.: US 9,625,868 B2
(45) Date of Patent: Apr. 18, 2017

(54) IMAGE FORMING APPARATUS

(71) Applicant: KYOCERA Document Solutions Inc., Osaka-shi, Osaka (JP)

(72) Inventor: Hirofumi Kuroki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/915,836

(22) PCT Filed: Mar. 27, 2015

(86) PCT No.: PCT/JP2015/059664
§ 371 (c)(1),
(2) Date: Mar. 1, 2016

(87) PCT Pub. No.: WO2015/159683
PCT Pub. Date: Oct. 22, 2015

(65) Prior Publication Data

US 2016/0200541 A1 Jul. 14, 2016

(30) Foreign Application Priority Data

Apr. 14, 2014 (JP) ..... 2014-082962

(51) Int. Cl.
*B65H 31/02* (2006.01)
*B65H 31/26* (2006.01)
(Continued)

(52) U.S. Cl.
CPC ..... *G03G 15/6552* (2013.01); *B65H 29/52* (2013.01); *B65H 31/02* (2013.01);
(Continued)

(58) Field of Classification Search
CPC ..... B65H 31/02; B65H 31/26; B65H 2405/11151; B65H 2405/114; B65H 2601/321; B65H 2601/325; G03G 15/6552
(Continued)

(56) References Cited

U.S. PATENT DOCUMENTS

2006/0008292 A1 1/2006 Watanabe
2008/0166141 A1 7/2008 Watanabe et al.
(Continued)

FOREIGN PATENT DOCUMENTS

JP 2006-023347 A 1/2006
JP 2008-087869 A 4/2008
(Continued)

OTHER PUBLICATIONS

International Search Report of PCT/JP2015/059664 mailed Jun. 9, 2015.

*Primary Examiner* — David H Bollinger
(74) *Attorney, Agent, or Firm* — Studebaker & Brackett PC

(57) ABSTRACT

An image forming apparatus (1) includes an apparatus body (2) including an image forming part (5) implementing an image forming process on a recording material (S); and a discharge tray (7) disposed at an upper part of the apparatus body (2), the discharge tray including a stacking surface (22) receiving the recording material (S) discharged after the image forming process; an outer edge part (23) located above the stacking surface (22) and provided while surrounding a periphery of the stacking surface (22); and a connecting surface (24) provided between the stacking surface (22) and the outer edge part (23), wherein the stacking surface (22) being formed such that a width thereof in a direction orthogonal to a discharge direction downstream in
(Continued)

Figure 1:
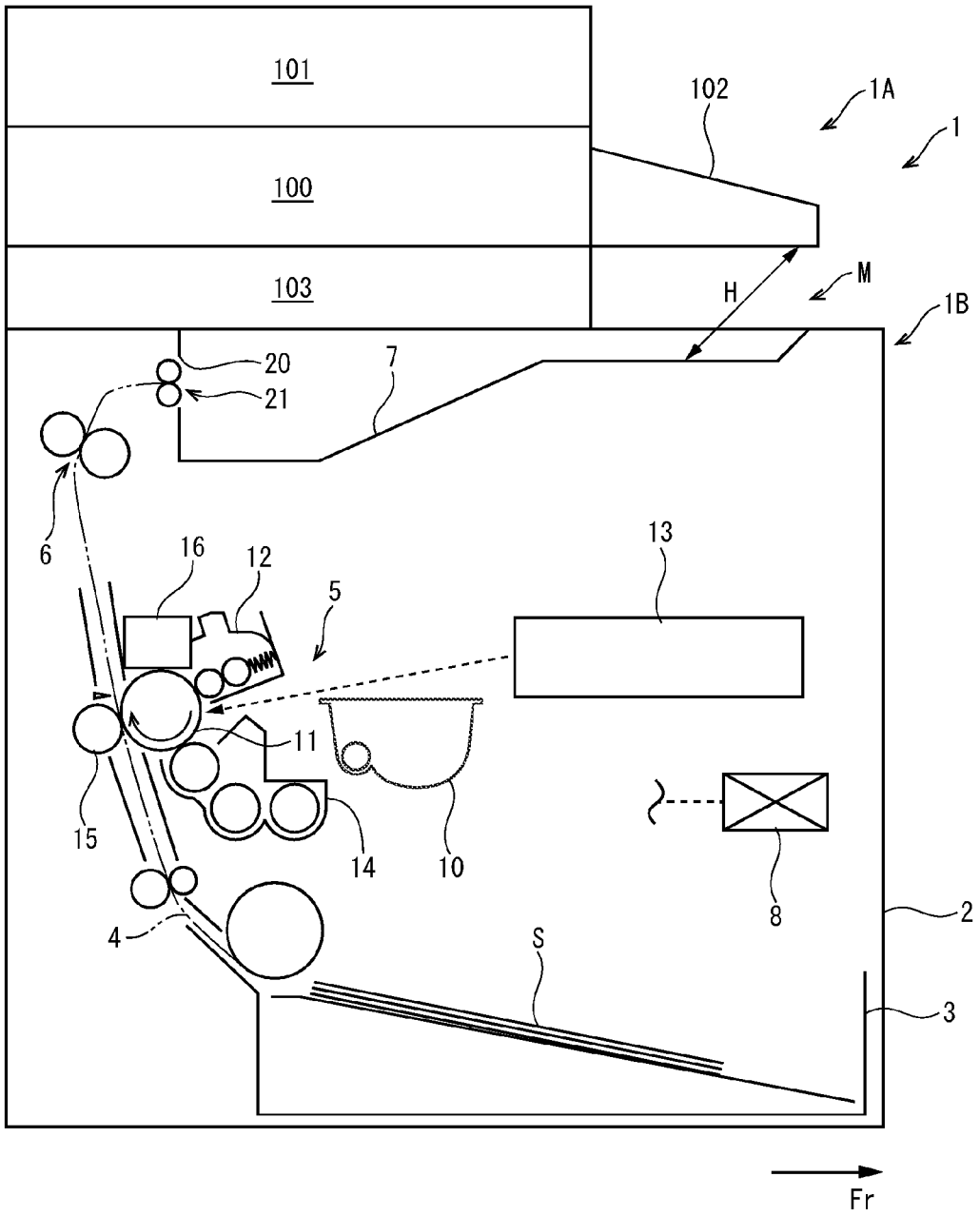

the discharge direction is wider than the width thereof upstream in the discharge direction.

9 Claims, 6 Drawing Sheets

(51) Int. Cl.
*G03G 15/00* (2006.01)
*B65H 29/52* (2006.01)

(52) U.S. Cl.
CPC ..... *B65H 31/26* (2013.01); *B65H 2301/4212* (2013.01); *B65H 2405/114* (2013.01); *B65H 2405/11151* (2013.01); *B65H 2601/321* (2013.01); *B65H 2601/325* (2013.01)

(58) Field of Classification Search
USPC ..... 271/207
See application file for complete search history.

(56) References Cited

U.S. PATENT DOCUMENTS

2009/0121414 A1* 5/2009 Ito ..... B65H 31/02 271/209
2009/0147324 A1 6/2009 Tamura
2011/0198801 A1* 8/2011 Yamaguchi ..... B65H 31/02 271/207
2012/0114407 A1* 5/2012 Nakamura ..... G03G 15/6552 400/642
2015/0277333 A1* 10/2015 Sato ..... G03G 15/6552 399/405

FOREIGN PATENT DOCUMENTS

JP 2008-168977 A 7/2008
JP 2009-139819 A 6/2009
JP 2012-188243 A 10/2012

* cited by examiner

IMAGE FORMING APPARATUS

TECHNICAL FIELD

The present disclosure relates to an image forming apparatus preferably applied in a printer, a multi-function printer or the like.

BACKGROUND ART

An image forming apparatus such as a printer executes an image forming process (printing) on a recording material such as a sheet of copy paper and discharges the printed recording material on a discharge tray.

For instance, the image forming apparatus includes a document reading part for reading image information of a document, an image forming part connected under the image reading part and implementing printing processes based on the read image information, and a sheet discharge part provided between the image reading part and the image forming part and receiving the sheet discharged after the printing process (see Patent Document 1). Such a so-called in-body sheet discharging type sheet discharge part includes an opening for taking out the printed sheet between the document reading part and the discharge tray.

PRIOR ART DOCUMENT

Patent Document

[PATENT DOCUMENT 1] Japanese patent laid-open publication No. 2009-139819

SUMMARY OF INVENTION

Problems to be Solved by the Invention

However, because such an in-body sheet discharging type image forming apparatus has a structure in which the discharge tray is hardly visible in general, the user has to insert his/her hand into the narrow opening to take out the printed sheet by feeling. Thus, the image forming apparatus described above has had a problem that it is unable to take out the sheet readily. In a case when the image forming apparatus is downsized in particular, a distance (opening) between the document reading part and the discharge tray decreases, so that there is a possibility that it becomes more difficult to take out the sheet.

Still further, in a case when the printing process is consecutively executed, there is a possibility that a discharged sheet jumps out of the discharge tray by being pushed by a succeeding discharged sheet. Still further, in a case when a plurality of sheets is stacked unevenly, there is a possibility that a sheet bundle collapses.

In order to solve the abovementioned problems, the present invention aims at providing an image forming apparatus including a discharge tray adequately holding a discharged recording material.

Means for Solving the Problem

An image forming apparatus of the present invention includes an apparatus body including an image forming part implementing an image forming process on a sheet-like recording material; and a discharge tray disposed at an upper part of the apparatus body, the discharge tray including; a stacking surface receiving the recording material discharged after the image forming process; an outer edge part located above the stacking surface and provided while surrounding a periphery of the stacking surface; and a connecting surface provided between the stacking surface and the outer edge part, wherein the stacking surface being formed such that a width thereof in a direction orthogonal to a discharge direction downstream in the discharge direction is wider than the width thereof upstream in the discharge direction.

EFFECTS OF THE INVENTION

The present invention makes it possible to appropriately hold the discharged recording material.

FIG. 1 It is a section view diagrammatically illustrating an internal structure of a multi-function printer according to one embodiment of the present invention.

Figure 2:
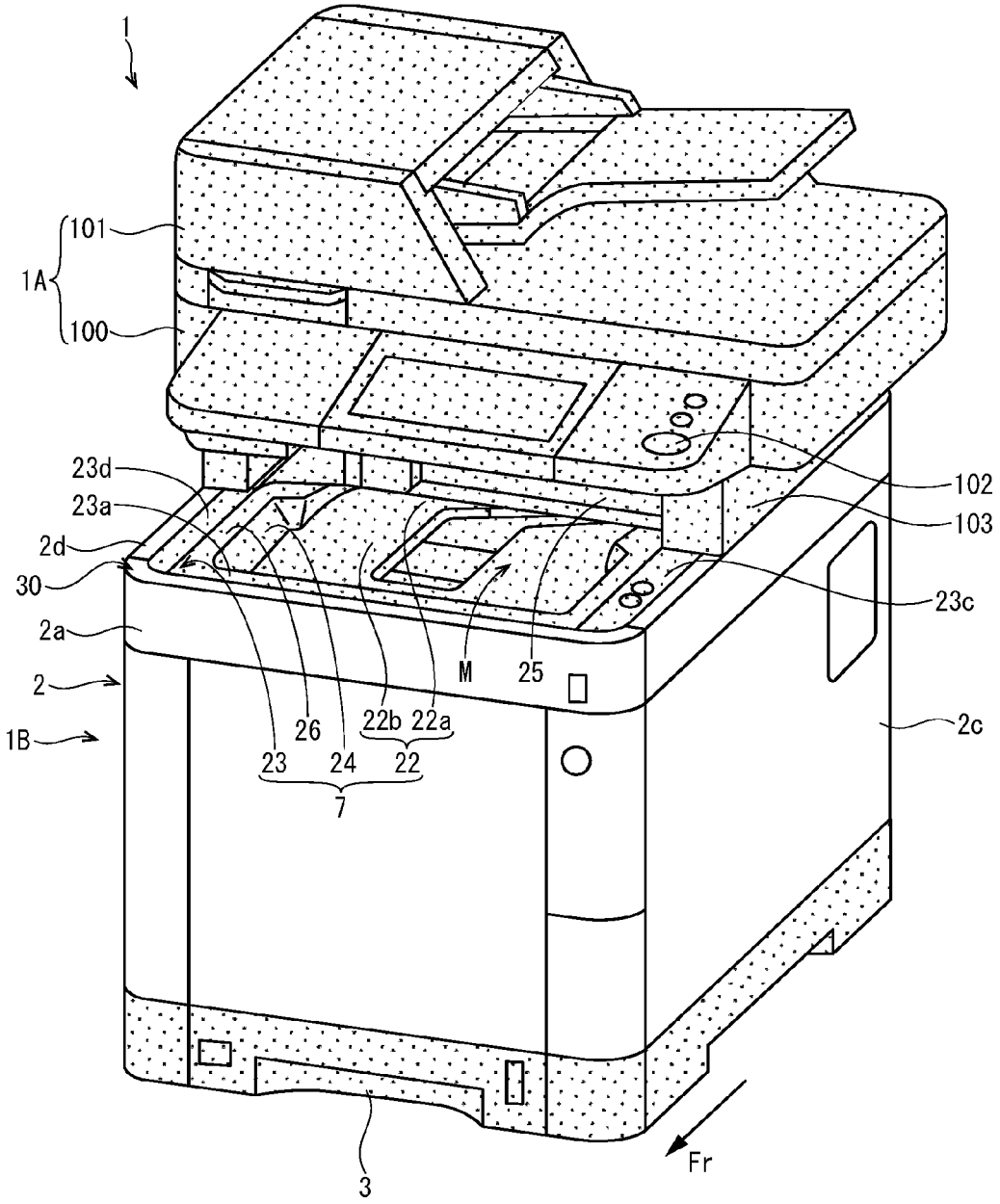

FIG. 2 It is a perspective view illustrating the multi-function printer according to one embodiment of the present invention.

Figure 3:
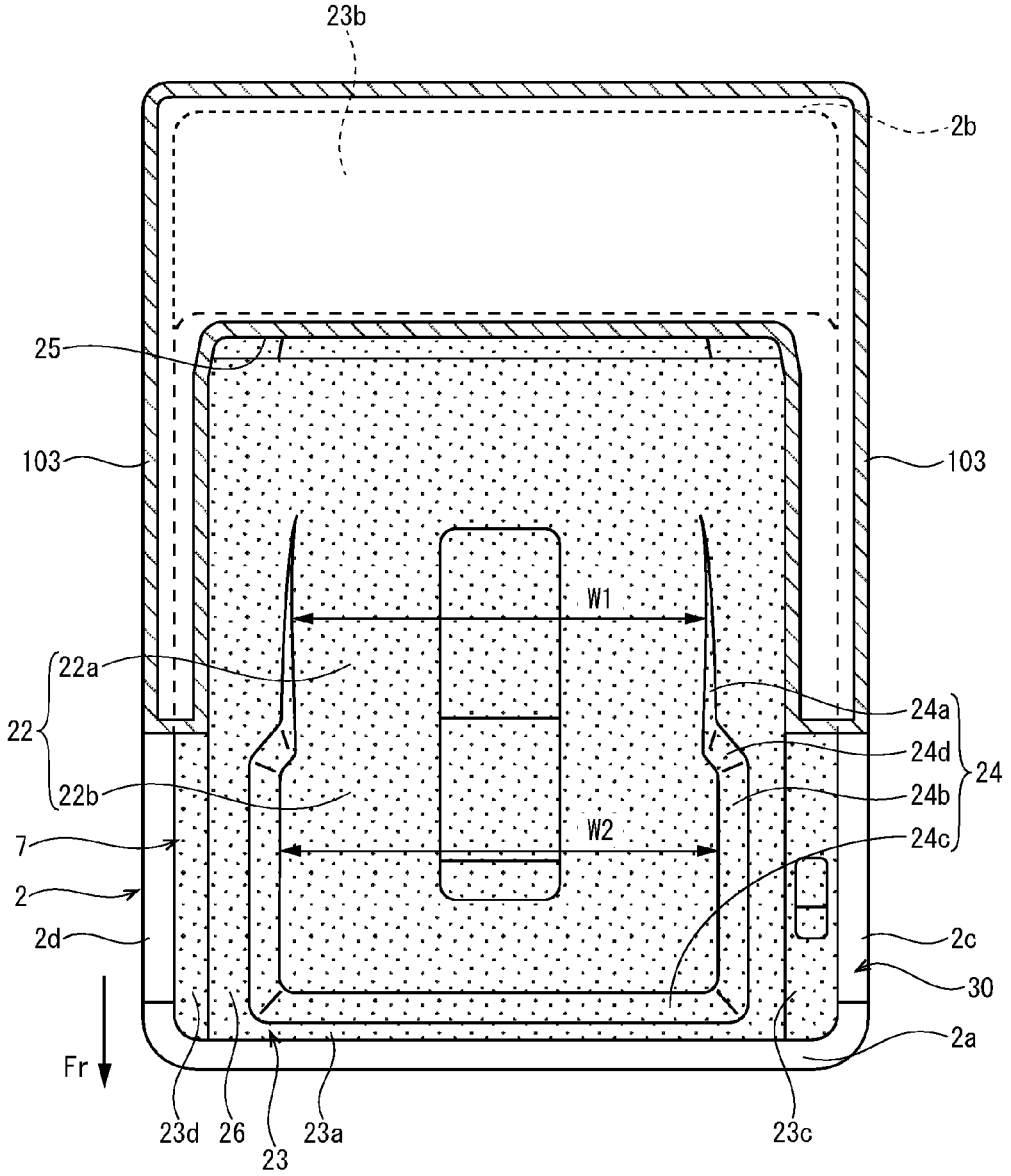

FIG. 3 It is a plan view illustrating a discharge tray and others of the multi-function printer of one embodiment of the present invention.

Figure 4:
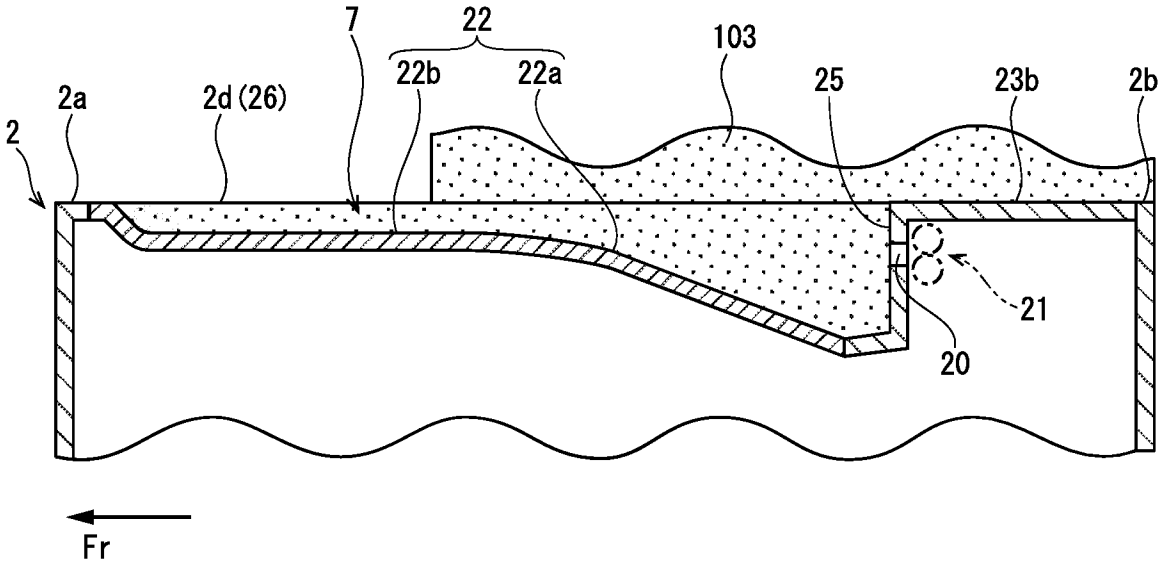

FIG. 4 It is a section view diagrammatically illustrating the discharge tray and others of the multi-function printer of one embodiment of the present invention.

Figure 5:
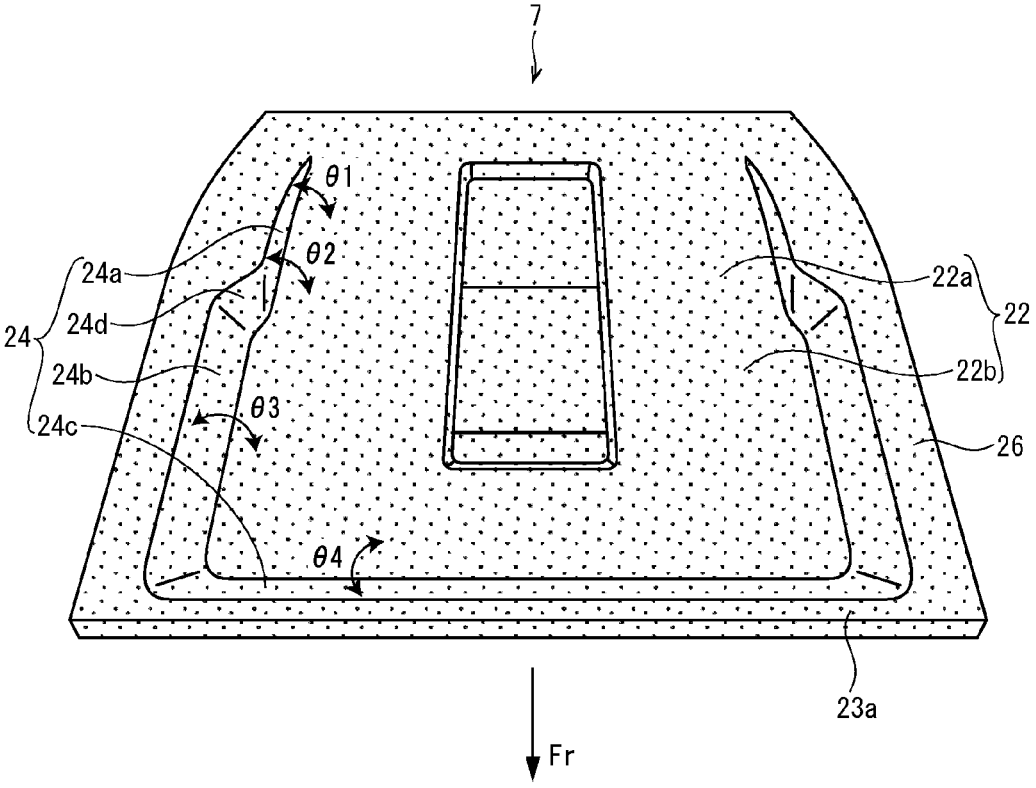

FIG. 5 It is a perspective view of the discharge tray of the multi-function printer of one embodiment of the present invention.

Figure 6:
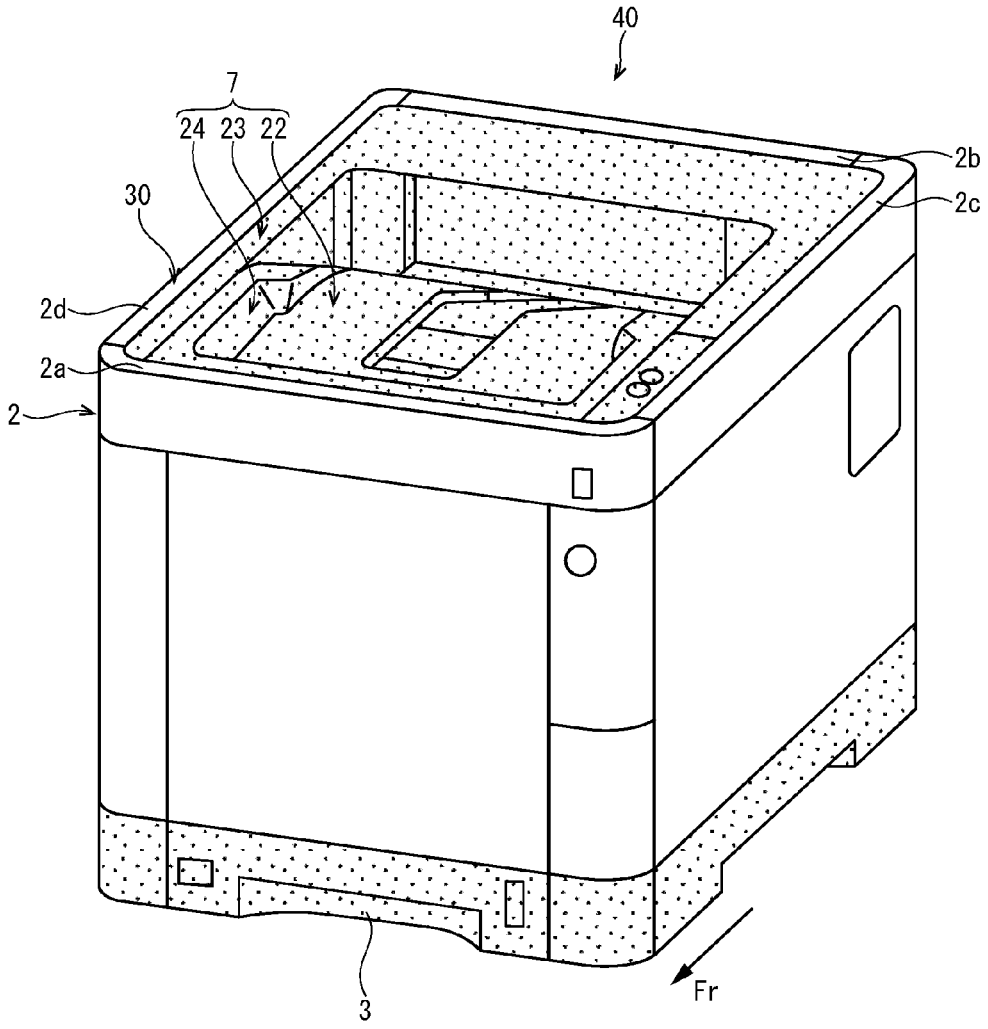

FIG. 6 It is a perspective view illustrating a printer of a modified example of one embodiment of the present invention.

A preferred embodiment of the present invention will be described below with reference to the attached drawings.

An outline of a multi-function printer 1, i.e., an image forming apparatus, of one embodiment will be described with reference to FIGS. 1 and 2. FIG. 1 is a section view diagrammatically illustrating an internal structure of a multi-function printer 1. FIG. 2 is a perspective view illustrating the multi-function printer 1. It is noted that a direction of an arrow Fr indicated in each drawing is assumed to be a front (front side) of the multi-function printer 1 for convenience of the following description.

The multi-function printer 1 includes an image reading apparatus 1A and a printing apparatus 1B.

The image reading apparatus 1A includes a scanning part 100 optically reading image information of a document, and an automatic document feeder 101 conveying the document to a reading position where the scanning part 100 reads the document. A front part of the scanning part 100, an operating part 102 including a liquid crystal panel, push buttons or the like. A user executes or changes setting of various functions of the multi-function printer 1 by operating the operating part 102. It is noted that the image reading apparatus 1A has a known normal structure, so that a detailed description thereof will be omitted here.

A surface of the image reading apparatus 1A (including a leg part 103 described later) is colored in black, i.e., in dark color. It is noted that parts colored in black are indicated by dots in each drawing.

The printing apparatus 1B includes an apparatus body 2, a sheet feed cassette 3, an image forming part 5, a fixing apparatus 6, a discharge tray 7, and a control unit 8.

The apparatus body 2 is formed substantially into a shape of a cube as an exterior member of the printing apparatus 1B. The apparatus body 2 includes the respective components of the printing apparatus 1B. The image reading apparatus 1A described above is supported on a rear upper surface of the apparatus body 2 (the discharge tray 7) through the leg part 103. That is, the apparatus body 2 is provided under the image reading apparatus 1A with a space between them.

The sheet feed cassette 3 is disposed at a lower part of the apparatus body 2 and is configured to be drawable to outside. The sheet feed cassette 3 stores sheets of paper S, i.e., the sheet-like recording materials (number of stored sheets: around 500 sheets in maximum). It is noted that the recording material is not limited to be the sheet S made of paper, and may be a resin film, an OHP sheet, or the like.

The image forming part 5 implements the image forming process, i.e., transfers the toner image, onto the sheet S supplied from the sheet feed cassette 3 to the conveying path 4. The image forming part 5 includes a toner container 10 storing replenished toner and a photosensitive drum 11 provided rotably around a shaft. A charger 12, a light scanning device 13, a developing device 14, a transfer roller 15, and a cleaning device 16 are arranged around the photosensitive drum 11 in transferring process order. The fixing apparatus 6 fixes the transferred toner image onto the sheet S.

A discharge port 20 communicating inside and outside of the apparatus body 2 is formed at a downstream end of the conveying path 4. Provided in a vicinity of the inside of the discharge port 20 is a discharge roller 21 delivering the sheet S which has undergone the fixing process to the discharge tray 7.

The discharge tray 7 is disposed at an upper part of the apparatus body 2. Accordingly, the discharge tray 7 is provided between the apparatus body 2 and the image reading apparatus 1A (the scanning part 100). A take-out opening M for taking out the sheet S from the discharge tray 7 is formed between the discharge tray 7 and the image reading apparatus 1A.

Here, the image forming process of the multi-function printer 1 will be briefly described. For instance, the printing apparatus 1B (the control unit 8) executes the image forming process based on image data read and photo-electrically converted by the image reading apparatus 1A or image data transmitted from an external device such as a personal computer, as follows.

The light scanning device 13 irradiates a laser beam (an arrow of broken line in FIG. 1) corresponding to the image data to the photosensitive drum 11. Thereby, an electrostatic latent image is formed on a surface of the photosensitive drum 11 charged with a predetermined potential by the charger 12. The developing device 14 develops the electrostatic latent image as a toner image by toner supplied from the toner container 10.

Meanwhile, the sheet S supplied from the sheet feed cassette 3 is conveyed through the conveying path 4 and passes between the photosensitive drum 11 and the transfer roller 15. Then, the transfer roller 15 transfers the toner image onto the sheet S by a transfer bias applied thereto. The sheet S which has undergone the fixing process of the fixing apparatus 6 is then discharged onto the discharge tray 7 from the discharge port 20. It is noted that the toner left on the photosensitive drum 11 is collected by the cleaning device 16.

Next, a configuration of an upper surface of the apparatus body 2 including the discharge tray 7 will be described in detail with reference to FIGS. 2 through 5. FIG. 3 is a plan view illustrating a discharge tray 7 and others. FIG. 4 is a section view diagrammatically illustrating the discharge tray 7 and others. FIG. 5 is a perspective view of the discharge tray 7.

As shown in FIG. 2, the discharge tray 7 is mounted on a frame (not shown) of the apparatus body 2 and composes an upper surface of the printing apparatus 1B. The discharge tray 7 is formed substantially into a rectangular shape in a plan view by using a synthetic resin material for example.

The discharge tray 7 is integrally formed while including a stacking surface 22, an outer edge part 23, and a connecting surface 24. The stacking surface 22 is formed to receive the sheet S which has undergone the image forming process and is discharged. The outer edge part 23 is located at a level above the stacking surface 22 so as to surround a periphery of the stacking surface 22. The connecting surface 24 is provided between the stacking surface 22 and the outer edge part 23.

As shown in FIGS. 3 through 5, the stacking surface 22 is formed into a size capable of stacking a maximum-size sheet S that can be discharged (on which the image forming process can be executed). The stacking surface 22 includes first and second tray surfaces 22*a* and 22*b*.

The first tray surface 22*a* is formed substantially into a rectangular shape in a plan view. The first tray surface 22*a* is provided upstream (rear side) in a discharge direction and is formed to incline upward toward the front side. The second tray surface 22*b* is formed substantially into a rectangular shape such that its widthwise (right-and-left direction) size is larger than that of the first tray surface 22*a* in a plan view. The second tray surface 22*b* is provided continuously from a front end part of the first tray surface 22*a* and is formed substantially horizontally to the front side.

A rear end part of the first tray surface 22*a* is located on a rear side of the apparatus body 2. Formed between the rear end part of the first tray surface 22*a* and a rear outer edge part 23*b* (described later) is a substantially vertical stepped surface 25 (see FIG. 4). The discharge port 20 described above is formed above the stepped surface 25 so as to be able to stack about 250 sheets S on the stacking surface 22. It is noted that the number of stackable sheets S may be arbitrarily set.

As shown in FIGS. 2 and 3, the outer edge part 23 includes a front outer edge part 23*a*, the rear outer edge part 23*b*, a left outer edge part 23*c*, and a right outer edge part 23*c*, which are formed integrally so as to surround a periphery of the stacking surface 22. The front outer edge part 23*a* is integrally formed so as to function also as a front end part of the second tray surface 22*b*. The right outer edge part 23*c* is formed to be slightly wider than the left outer edge part 23*d* in a plan view. The rear outer edge part 23*b* is formed to be wider than the right outer edge part 23*c* in a plan view.

As shown in FIGS. 2, 3 and 5, inner edge surfaces 26 are formed respectively inside of the both right and left outer edge parts 23*c* and 23*d*. The front sides of the respective inner edge surfaces 26 are formed in flush with the respective outer edge parts 23*c* and 23*d*. The rear sides of the respective inner edge surfaces 26 are formed to incline downward toward the rear side. The rear end parts of the respective inner edge surfaces 26 are in flush with the first tray surface 22*a*.

As shown in FIGS. 3 and 5, the connecting surface 24 is formed to incline upward from the stacking surface 22 to the outside. More specifically, the connecting surface 24 includes a pair of right and left first guide faces 24*a*, a pair of right and left second guide faces 24*b*, and a third guide face 24*c*. The pair of right and left first guide faces 24*a* is disposed so as to face with each other at widthwise both sides of the first tray surface 22*a*. The pair of right and left second guide faces 24*b* is disposed so as to face with each other at widthwise both sides of the second tray surface 22*b*.

The third guide face 24*c* is disposed at a downstream end part (front end part) in the discharge direction of the second tray surface 22*b*.

The pair of right and left first guide faces 24*a* is disposed symmetrically and substantially in parallel with each other. The pair of right and left first guide faces 24*a* is formed between both right and left end parts of the first tray surface 22*a* and the rear sides of the respective inner edge surfaces 26. The respective first guide faces 24*a* are formed such that their height increases gradually from the rear side toward the front side. An angle formed between the first tray surface 22*a* and the respective first guide faces 24*a* increases gradually from the rear side toward the front side. That is, the concerned angle θ2 at the front part of the first guide faces 24*a* is larger than the concerned angle θ1 at the rear part of the first guide face 24*a* (θ2>θ1). While the angle θ1 formed between the first tray surface 22*a* and the first guide face 24*a* is around 100 degrees, the angle θ2 is around 120 degrees. It is noted that a space W1 between the pair of right and left first guide faces 24*a* (horizontal width of the first tray surface 22*a*) is formed to be larger than a width of the dischargeable maximum sheet S.

The pair of right and left second guide faces 24*b* is disposed symmetrically and substantially in parallel with each other. The pair of right and left second guide faces 24*b* is formed between both right and left end parts of the second tray surface 22*b* and the front side of the respective inner edge surfaces 26. An angle θ3 formed between the second tray surface 22*b* and the second guide faces 24*b* is set to be 135 degrees. Because the second tray surface 22*b* is formed to be wider than the first tray surface 22*a*, a space W2 between the pair of right and left second guide faces 24*b* is wider than the space W1 between the pair of right and left first guide faces 24*a* (W2>W1).

The third guide face 24*c* is formed between the front end part of the second tray surface 22*b* and the front outer edge part 23*a*. An angle θ4 formed between the second tray surface 22*b* and the third guide face 24*c* is set to be about 135 degrees. It is noted that while the height of the respective second guide faces 24*b* and the third guide face 24*c* is arbitrary, it is set to be about 20 mm in the present embodiment. That is, the second tray surface 22*b* is formed at a level lower than the outer edge part 23 (the inner edge surface 26) by about 20 mm.

As described above, the angles θ1 through θ4 formed between the stacking surface 22 and the connecting surface 24 are formed to be larger on the downstream side in the discharge direction than those on the upstream side in the discharge direction. It is noted that the angles of the connecting surface 24 with respect to the stacking surface 22 are not limited to the angles described above, and may be arbitrary set within a range more than 90 degrees and less than 180 degrees.

Still further, bending surfaces 24*d* are formed respectively between the first guide faces 24*a* and the second guide faces 24*b*. The pair of right and left bending surfaces 24*d* extends respectively from the first guide faces 24*a* toward the outside and is connected with the second guide faces 24*b*. Accordingly, the first guide faces 24*a*, the bending surfaces 24*d*, and the second guide faces 24*b* are formed into a shape of crank in a plan view.

An entire upper surface of the discharge tray 7 is colored in black, i.e., in dark color. That is, the discharge tray 7 is colored in color whose brightness is low as compared to an ordinary white sheet S (plain sheet).

As shown in FIGS. 2 and 3, the apparatus body 2 includes a front exterior part 2*a*, a rear exterior part 2*b*, a right exterior part 2*c*, and a left exterior part 2*d*.

The four exterior parts 2*a* through 2*d* are formed substantially into a rectangular shape in a side view by using a synthetic resin material for example. The four exterior parts 2*a* through 2*d* are mounted to a frame of the apparatus body 2 so as to surround the periphery of the discharge tray 7 and compose front, rear, right, and left outer surfaces of the printing apparatus 1B. Upper end surfaces of the four exterior parts 2*a* through 2*d* are formed to be in flush with upper surfaces of the respectively corresponding outer edge parts 23*a* through 23*d*.

Lower parts of the four exterior parts 2*a* through 2*d* (part where the sheet feed cassette 3 is attached) are colored in black, respectively. The four exterior parts 2*a* through 2*d* are colored respectively in white, i.e., a bright color, except the lower parts where the sheet feed cassette 3 is attached. Still further, upper end surface of the four exterior parts 2*a* through 2*d* are colored in white, respectively. Thereby, the upper end surface of the apparatus body 2 composes a bright color part 30 colored with a color brighter than that of the discharge tray 7.

The bright-color part 30 is formed continuously like a belt around the discharge tray 7. That is, in a state in which the image reading apparatus 1A is removed, the bright-color part 30 is formed into a shape of a rectangular ring in a plan view. Actually, because the image reading apparatus 1A is mounted on the rear side of the discharge tray 7, more than a half of the rear side of the bright-color part 30 is covered by the image reading apparatus 1A (the leg part 103). Accordingly, the front part (the upper end surface of the front exterior part 2*a* and the front upper end surfaces of the pair of right and left exterior parts 2*c* and 2*d*) of the bright-color part 30 is exposed to the take-out opening M.

According to the multi-function printer 1 of the present embodiment described above, because the stacking surface 22 is provided concavely under the outer edge part 23, the discharged sheet *S can* be held appropriately. For instance, in a case when the image forming process is consecutively executed, it is possible to prevent the sheet S stacked on the stacking surface 22 from jumping out of the discharge tray 7 by being pushed out by a sheet S discharged next.

Still further, the stacking surface 22 is formed such that the width (direction) thereof orthogonal to the discharge direction on the downstream side (front side) in the discharge direction is larger than that of the upstream side (rear side) of the discharge direction of the sheet S. Therefore, the space between the connecting surfaces 24 facing in the width direction of the stacking surface 22 of the front side is wider than that of the rear side. Accordingly, the pair of right and left first guide faces 24*a* disposed on the rear side restricts widthwise position of the sheet S being discharged. This arrangement makes it possible to stack the plurality of sheets S while aligning on the stacking surface 22 and to prevent a collapse of a bundle of the sheets S. Still further, because the second tray surface 22*b* (the space W2 between the pair of right and left second guide faces 24*b*) disposed on the front side (the take-out opening M) is wide, the user can readily take out the sheets S stacked on the stacking surface 22.

Still further, according to the multi-function printer 1 of the present embodiment, it is possible to effectively restrict the position of the sheet S being discharged by substantially erecting the respective first guide faces 24*a*. That is, the sheet S is discharged out of the apparatus body 2 while being aligned by the pair of first guide faces 24*a* and is stacked on the respective tray surfaces 22*a* and 22*b*. Still further, the stacking surface 22 (the second tray surface 22*b*) is widely opened upward by inclining (laying) the respective second guide faces 24*b* and the third guide face 24*c* toward the outside. Thereby, the user can take out the sheet S more readily.

Although the so-called in-body sheet discharging type multi-function printer 1 has the structure in which the discharge tray 7 is hardly visible, it is possible to assure a large distance H (see FIG. 1) between the stacking surface 22 and the image reading apparatus 1A (or more accurately, the front end part of the operating part 102) because the stacking surface 22 is located under the outer edge part 23. Still further, it is possible to widen the take-out opening M by providing the third guide face 24*c* at the front end part of the second tray surface 22*b*. Thereby, the user can readily take out the sheet S on the wide second tray surface 22*b* from the take-out opening M.

Because the stacking surface 22 of the discharge tray 7 is colored in the dark color, a difference of brightness between the stacking surface 22 and the sheet S (e.g., white plain sheet) increases. Thereby, the user can readily confirm the sheet S discharged on the discharge tray 7. Meanwhile, the bright-color part 30 colored in a color brighter than that of the stacking surface 22 is formed on the outside of the stacking surface 22 of the discharge tray 7. Accordingly, the bright-color part 30 highlights the stacking surface 22 and clarifies a discharge area of the sheet S. Thereby, the user can take out the sheet S on the stacking surface 22 by marking the bright-color part 30. Still further, although the so-called in-body sheet discharging type multi-function printer 1 has the structure in which the discharge tray 7 is hardly visible, the user can visually recognize that the discharge tray 7 exists by the bright-color part 30.

It is noted that while the case in which the present invention is applied to the in-body sheet discharging type multi-function printer 1 has been described in the embodiment described above, the present invention is not limited to such a case. For instance, the discharge tray 7 described above may be applied to a printer 40 from which the image reading apparatus 1A is removed as shown in FIG. 6. It is noted that because the printer 40 has the similar configuration with the printing apparatus 1B described above, a detailed description of the printer 40 will be omitted here.

It is noted that while the stacking surface 22 is composed of the two tray surfaces 22*a* and 22*b* whose horizontal widths are different and the connecting surfaces 24 on the both right and left sides are formed into a shape of a crank in the multi-function printer 1 and others of the present embodiment, the present invention is not limited to such configuration. For instance, a plan shape of the stacking surface may be formed into a trapezoidal shape in which the width thereof is widened from the rear side to the front side. In this case, the respective first guide faces 24*a* may be connected straightly with the respective second guide faces 24*b* by omitting the respective bending surfaces 24*d*.

It is noted that the entire discharge tray 7 is colored in dark color in the multi-function printer 1 or the like of the present embodiment, the present invention is not limited to such arrangement. At least the stacking surface 22 and the stepped surface 25 (around the discharge port 20) of the discharge tray 7 may be colored in dark color.

It is noted that while the bright-color part 30 is constructed at the upper end surface of the apparatus body 2 in the multi-function printer 1 and others of the present embodiment, the present invention is not limited to such configuration. The bright-color part 30 may be formed at least one of the upper end surface of the apparatus body 2 and the outer edge parts 23 (23*a* through 23*d*) of the discharge tray 7. It is noted that while the bright-color part 30 has been formed into the continuous belt-like shape, the present invention is not limited to such configuration, and the bright-color part 30 may be formed discontinuously.

It is noted that the discharge tray 7 is colored in black and the apparatus body 2 (the bright-color part 30) is colored in white in the multi-function printer 1 and other of the present embodiment, the present invention is not limited to such configuration. For instance, the discharge tray 7 may be colored in gray or dark blue whose brightness is low, and the bright-color part 30 may be colored in gray or cream color whose brightness is high. It is noted that it is preferable to set the difference of brightness between the color of the discharge tray 7 and the color (white) of the sheet S is 3 or more in terms of Munsell color system. It is also preferable to set the brightness of the color of the bright-color part 30 to be 7 or more in terms of Munsell color system.

It is noted that a coloring method of the apparatus body 2 and the discharge tray 7 is arbitrary. For instance, it is possible to use a colored resin material or to color by painting.

It is noted that the case when the present invention is applied to the monochrome multi-function printer or the like has been described as one example in the respective embodiments, the present invention is not limited to such a case, and the present invention is also applicable to a full-color printer, a facsimile machine or the like for example.

While the preferable embodiment and its modified example of the image forming apparatus of the present invention have been described above and various technically preferable configurations have been illustrated, a technical range of the invention is not to be restricted by the description and illustration of the embodiment. Further, the components in the embodiment of the invention may be suitably replaced with other components, or variously combined with the other components. The claims are not restricted by the description of the embodiment of the invention as mentioned above.

What is claimed is:

1. An image forming apparatus comprising:

an apparatus body including an image forming part implementing an image forming process on a sheet-like recording material; and a discharge tray disposed at an upper part of the apparatus body, the discharge tray including;

a stacking surface receiving the recording material discharged after the image forming process;

an outer edge part located above the stacking surface and provided while surrounding a periphery of the stacking surface; and a connecting surface provided between the stacking surface and the outer edge part, wherein the stacking surface being formed such that a width thereof in a direction orthogonal to a discharge direction downstream in the discharge direction is wider than the width thereof upstream in the discharge direction, wherein the connecting surface is formed to incline upward from the stacking surface to the outside of the stacking surface, and an angle formed between the stacking surface and the connecting surface downstream in the discharge direction is larger than that upstream in the discharge direction.

2. The image forming apparatus according to claim 1, wherein an angle of the connecting surface with respect to the stacking surface is set within a range of more than 90 degrees and less than 180 degrees.

3. The image forming apparatus according to claim 1, further comprising an image reading apparatus reading image information of a document, wherein the apparatus body is provided under the image reading apparatus, and the discharge tray is provided between the apparatus body and the image reading apparatus.

4. The image forming apparatus according to claim 1, wherein the stacking surface is colored in dark color, and at least one of the upper end surface and the outer edge parts of the apparatus body composes a bright color part colored in color brighter than that of the stacking surface.

5. An image forming apparatus comprising:

an apparatus body including an image forming part implementing an image forming process on a sheet-like recording material; and a discharge tray disposed at an upper part of the apparatus body, the discharge tray including;

a stacking surface receiving the recording material discharged after the image forming process;

an outer edge part located above the stacking surface and provided while surrounding a periphery of the stacking surface; and a connecting surface provided between the stacking surface and the outer edge part, wherein the stacking surface being formed such that a width thereof in a direction orthogonal to a discharge direction downstream in the discharge direction is wider than the width thereof upstream in the discharge direction, wherein the stacking surface includes:

a first tray surface provided upstream in the discharge direction; and a second tray surface formed to be wider than the first tray surface and provided downstream in the discharge direction, and the connecting surface includes:

a pair of first guide faces disposed to face with each other on both widthwise sides of the first tray surface;

a pair of second guide faces disposed to face with each other on both widthwise sides of the second tray surface; and a third guide face disposed at a downstream end part in the discharge direction of the second tray surface.

6. The image forming apparatus according to claim 5, wherein a height ranging from the upstream side in the discharge direction to the downstream side in the discharge direction on the respective first guide faces is formed so as to gradually increase.

7. The image forming apparatus according to claim 5, wherein an angle of each first guide face from the upstream side in the discharge direction to the downstream side in the discharge direction with respect to the first tray surface is formed so as to gradually increase.

8. The image forming apparatus according to claim 5, further comprising a pair of bending surfaces extending from the respective first guide faces toward the outside and being connected with the respective second guide faces.

9. The image forming apparatus according to claim 5, further comprising a pair of inner edge surfaces are formed respectively inside of the outer edge parts on the both sides in the width direction orthogonal to the discharge direction, wherein the first tray surface and the inner edge surfaces are formed to incline upward from the upstream side in the discharge direction to the downstream side in the discharge direction, and the upstream end part in the discharge direction of the inner edge surface is in flush with the first tray surface.

* * * * *